US005692681A

United States Patent [19]

Steinhauser et al.

[11] Patent Number: 5,692,681

[45] Date of Patent: Dec. 2, 1997

[54] ELECTRICAL PLUG CONNECTOR

[75] Inventors: Uwe Steinhauser, Filderstadt; Stefan Fenger, Waiblingen, both of Germany

[73] Assignee: Robert Bosch GmbH, Stuttgart, Germany

[21] Appl. No.: 620,679

[22] Filed: Mar. 19, 1996

[30] Foreign Application Priority Data

Apr. 8, 1995 [DE] Germany ..... 295 06 134 U

[51] Int. Cl.[6] ..... H01R 13/627

[52] U.S. Cl. ..... 439/358; 439/677

[58] Field of Search ..... 439/357, 358, 439/350, 677

[56] References Cited

U.S. PATENT DOCUMENTS

| | | | |
|---|---|---|---|
| 4,420,209 | 12/1983 | Reis et al. | 439/677 |
| 4,726,791 | 2/1988 | Rudy, Jr. et al. | 439/677 |
| 5,308,261 | 5/1994 | Kightlinger | 439/358 |
| 5,382,177 | 1/1995 | Hutchinson et al. | 439/358 |

FOREIGN PATENT DOCUMENTS

| | | |
|---|---|---|
| 40 41 576 | 6/1992 | Germany . |
| 42 35 271 | 9/1993 | Germany . |

*Primary Examiner*—Khiem Nguyen
*Assistant Examiner*—Yong Ki Kim
*Attorney, Agent, or Firm*—Kenyon & Kenyon

[57] ABSTRACT

An electrical plug connector for electrically connecting and mechanically interlocking with a mating connector, including a connector housing having an outer support member. The outer support member is positioned substantially in the middle of the connector housing. The plug connector also includes a snap-on surface and a snap-fit device which is pre-molded to the connector housing. The snap-fit device includes a U-shaped bending bar which has a first limb and a second limb. The first limb is secured to the outer support member with a first connecting end and the second limb includes an unattached end and an orifice. The orifice is positioned substantially at the unattached end for engaging with a snap-on surface of the mating connector when the electrical plug connector is inserted into an opening of the mating connector. The plug connector is intended for use in electronic control instruments in motor vehicles.

19 Claims, 3 Drawing Sheets

ELECTRICAL PLUG CONNECTOR

FIELD OF THE INVENTION

The present invention relates to, an electrical plug connector and, in particular, a rugged and shake-proof electrical plug connector.

BACKGROUND INFORMATION

German Patent No. 42 35 271 C1 describes a plug connector having a stop spring made of spring steel, which is embedded in the plastic of the plug-connector housing and prevents the plug-in connection from becoming unintentionally loosened. However, a separate stop spring of this kind can be easily lost.

Given the considerable mechanical stresses such plug-in connections are subject to, stresses as occur, for example, when working with electrical control units on board a motor vehicle, the elements necessary for interlocking purposes must have an especially rugged type of construction to reliably prevent any loosening of the plug connection caused by the considerable mechanical stresses during operation of the motor vehicle.

Plug connectors with a stop spring are already known, the stop spring being made of the material of the plug-connector housing and connected to or rather extruded on to the housing, as set forth in German Patent Application No. 40 41 576 A1. However, instead of one single stop spring, these plug connectors have two, making them too unwieldy and bulky for many applications.

An object of the present invention is to avoid these disadvantages and to create a plug connector that is capable of having a very small and compact design and of being realized as a rugged and shake-proof plug connector.

SUMMARY OF THE INVENTION

This objective is solved in accordance with the present invention by, for example, having different lever lengths that are effective on the bending bar during spring deflection and rebound travel, because this permits a variable, in particular optimal rating of the releasing/loosening and interlocking forces. In addition, it is advantageous that a polarization coding can be carried out directly on the plug connector. Finally, it is also advantageous that the plug connector bears a tubular-ring-shaped seal provided with transverse ribs. Such a seal guarantees considerable protection from the ingress of dirt and moisture into the plug-in connection.

DETAILED DESCRIPTION

Figure 2:
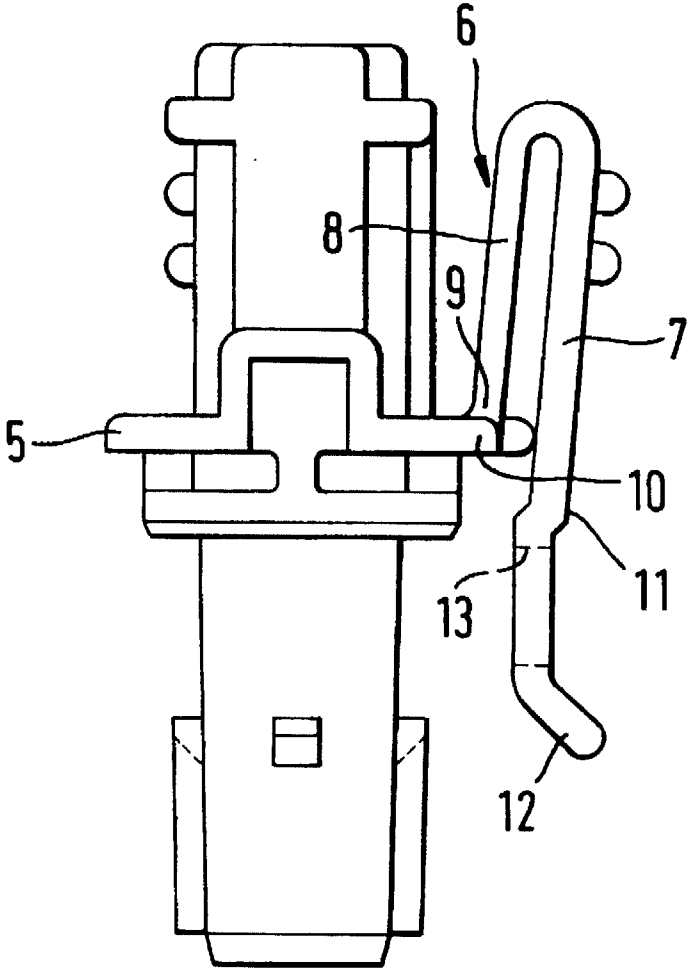
FIG. 2 shows a side view of the plug connector housing of the present invention.
Figure 1:
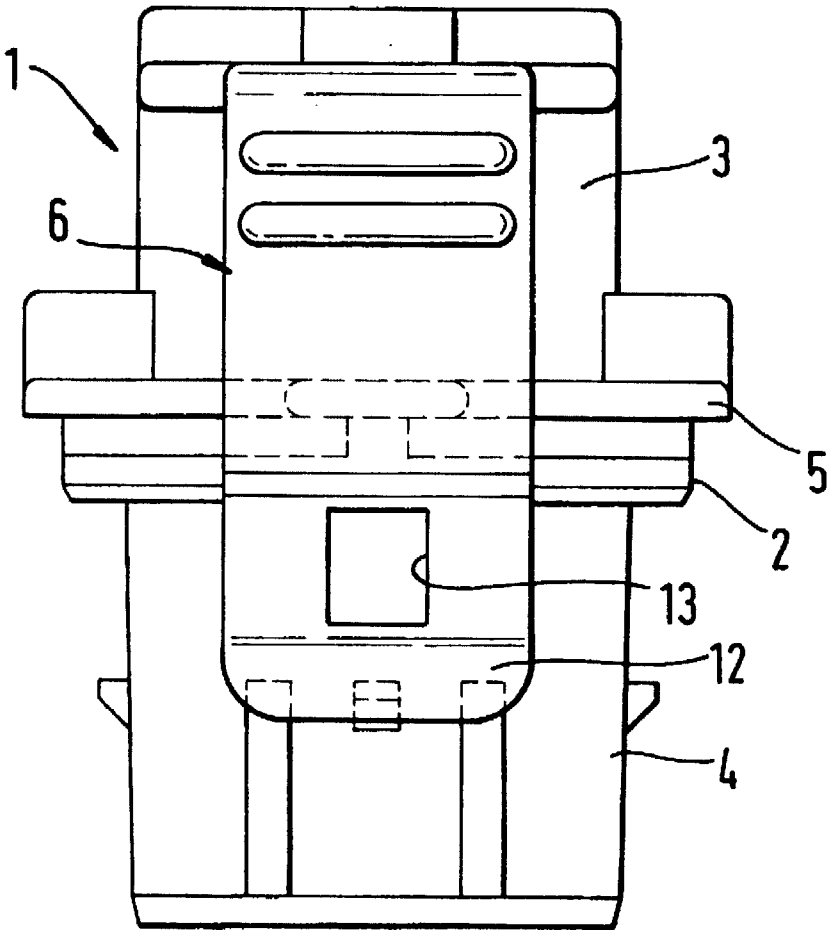
FIG. 1 shows a front view of a plug connector, according to the embodiments of the present invention.

FIGS. 1 and 2 illustrate a front and a side view of a plug connector 1 manufactured from plastic having a plug connector housing 2 with a line terminal part 3 and an insertion part 4, a flange 5 being disposed at or near the middle of the plug connector housing 2. A snap-fit device 6 is pre-molded on the flange 5. The snap-fit device is designed as a U-shaped bending bar 7 having an inner limb 8 and an outer limb 11. Inner limb 8 is secured by its end 9 to an outer support 10 which is mounted on the flange 5. On its unattached end 12, outer limb 11 includes a window/orifice 13 for cooperating with a snap-on surface of a mating connector (not shown).

Support point member 14 is formed on the flange 5 in the area of the abutment 10 for outer limb 11. Support point member 14 whose effect is such that only one short lever arm is effective when the snap-fit device 6 is deflected after outer limb 11 makes contact, however, during rebound travel, one lever arm of the entire length of the U-shaped bending bar 7 is active. A grip strip 15 enables the snap-fit device 6 to be easily manipulated with one finger.

Figure 3:
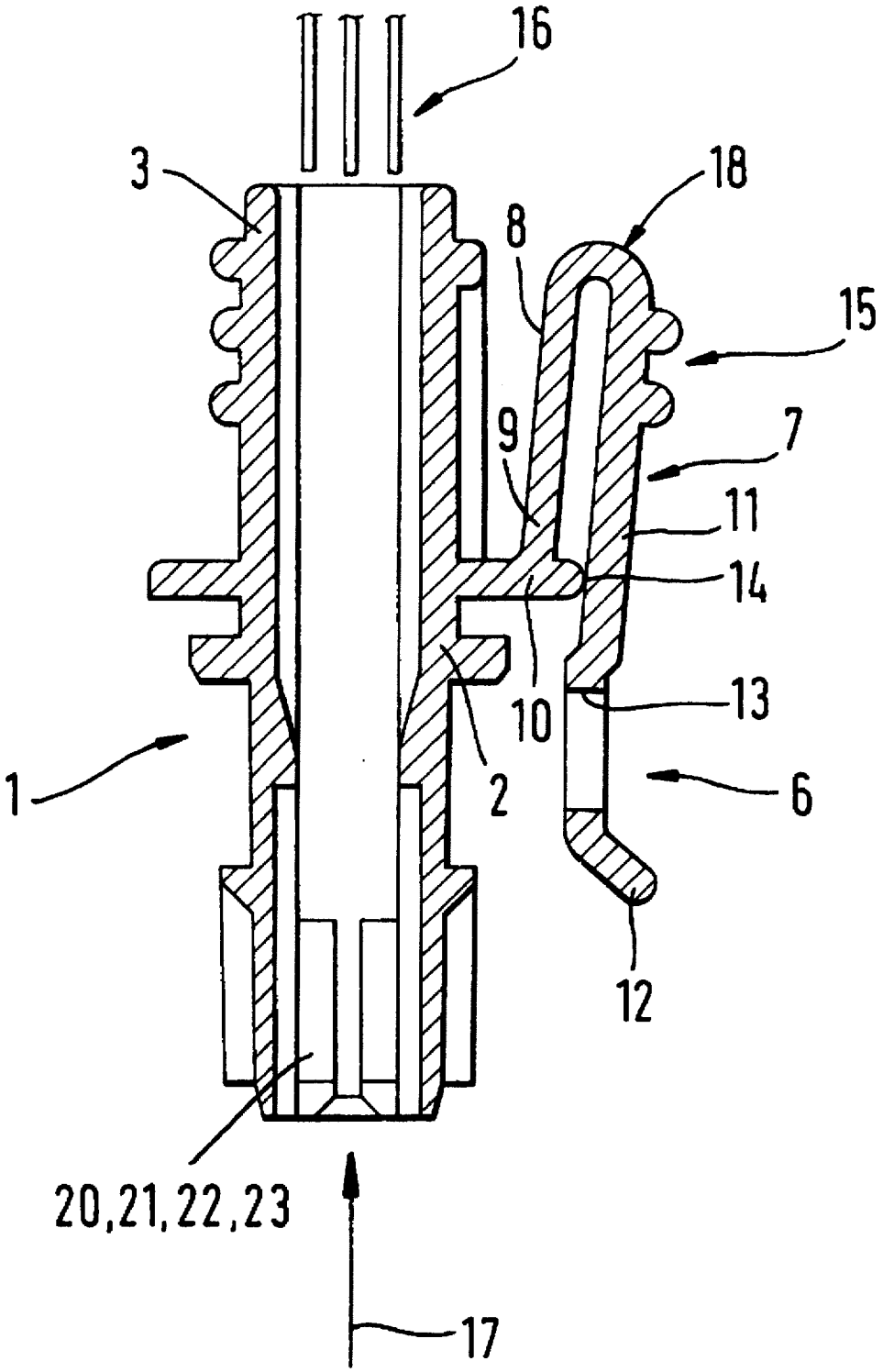
FIG. 3 shows a cross-sectional view of the plug connector housing.

FIG. 3 illustrates a cross-sectional view of plug connector housing 2. The metallic conductor lugs and plug pins situated inside the plug connector housing 2 are not shown in this representation. Three supply lines 16 are indicated in the area of the line terminal part 3; however, a different number of supply lines is likewise possible. A plug-in direction 17 is indicated by an arrow on the other side of the plug connector housing 2, opposite line terminal part 3. Moreover, the inner limb 8 and the outer limb 11 of the U-shaped bending bar 7 are arranged parallel side by side and in the plug-in direction 17 of the plug connector. The bending bar 7 has a base 18, which interconnects the two limbs 8 and 11. This base 18 is situated in the area of the terminal connection part 3 of the plug connector 1.

Figure 5:
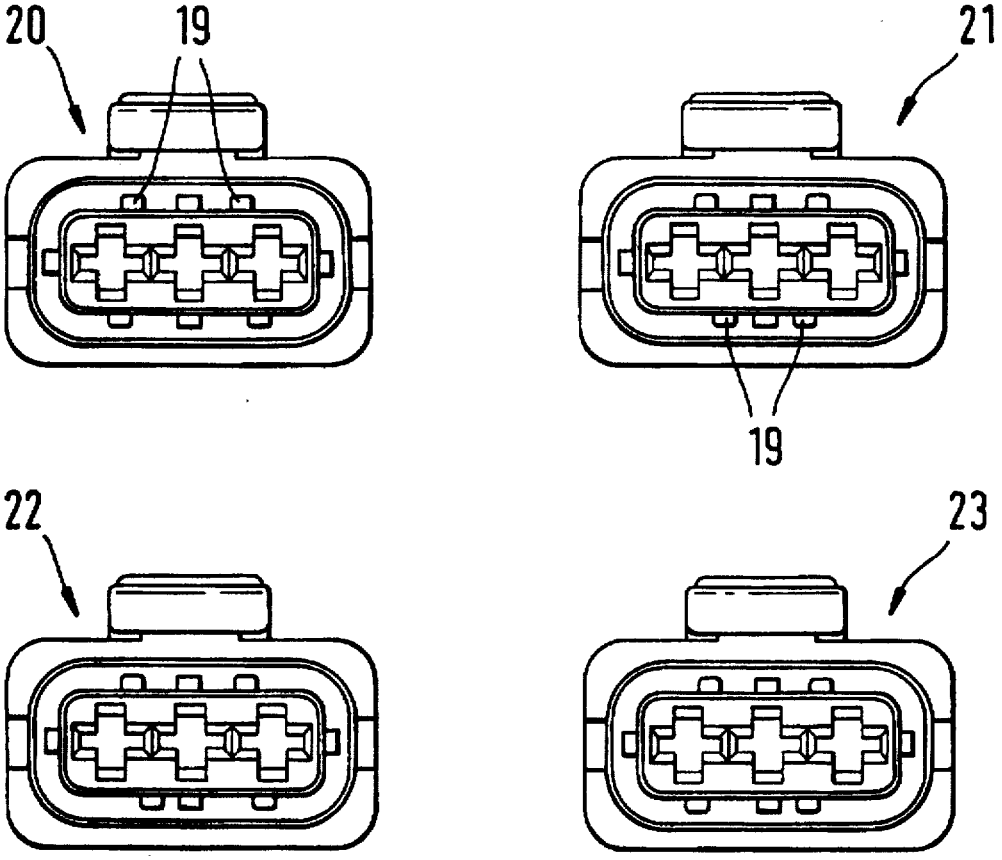
FIG. 5 illustrates four embodiments of the plug connector housing in a plug-in directional view.

FIG. 5 illustrates four embodiments of the plug connector housing 2 in a plug-in directional view. The insertion part 4 includes a plurality of longitudinal ribs 19, having varying distances from one another. Thus, the longitudinal ribs 19 form different polarization codes 20, 21, 22 and 23. The longitudinal ribs 19 and polarization codes 20 through 23 are varied by changing inserts or parts during injection molding.

Figure 4:
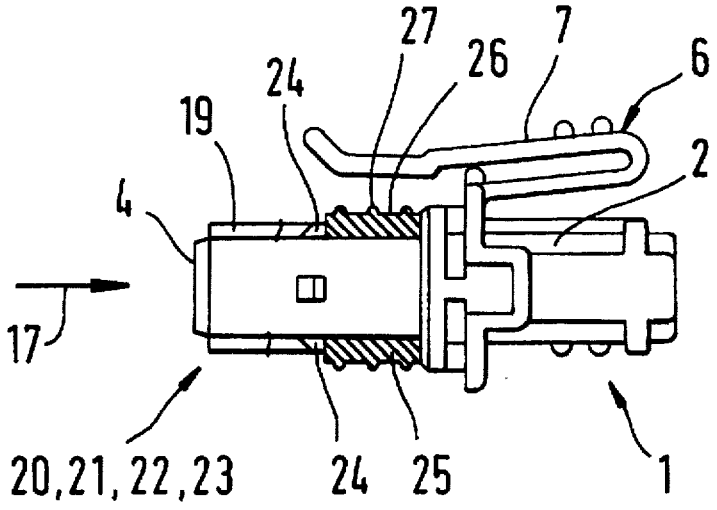
FIG. 4 shows the side view of the plug connector housing having a seal, according to the embodiments of the present invention.

In addition, FIG. 4 illustrates the side view of the plug connector 1 which includes the insertion part 4 on the outside of the plug connector housing 2. The insertion part 4 has two supporting projections 24, which retain a tubular ring-shaped seal 25 on the insertion part 4. The seal 25 has a surface area 26 which is provided with transverse ribs 27 to form one kind of sealing lips. This seal 25 helps to ensure that the connection of the plug connector 1 with a mating connector allows neither the ingress of dirt nor of moisture.

What is claimed is:

1. An electrical plug connector for electrically connecting and mechanically interlocking with a mating connector, the mating connector having a mating snap-on surface and a mating opening, the electrical plug connector comprising:

a connector housing having an outer support member;

a snap-on surface and a snap-fit device pre-molded to the connector housing, the snap-fit device including a U-shaped bending bar; and wherein the bending bar includes a first limb and a second limb, the first limb secured to the outer support member with a first connecting end, the second limb having an unattached end and an orifice, the orifice positioned substantially at the unattached end for engaging with the mating snap-on surface of the mating connector when the electrical plug connector is inserted into the mating opening of the mating connector.

2. The electrical plug connector as recited in claim 1, wherein the second limb of the bending bar includes a support point member positioned approximately at a center portion of the second limb, and wherein the outer support member is positioned in a middle portion of the connector housing.

3. The electrical plug connector as recited in claim 1, wherein the snap-fit device includes a grip strip for actuating the bending bar with a finger, the grip strip is provided on the unattached end of the second limb.

4. An electrical plug connector for electrically connecting and mechanically interlocking with a mating connector, the mating connector having a mating snap-on surface and a mating opening, the electrical plug connector comprising:

a connector housing having an outer support member positioned in a middle portion of the connector housing;

a snap-on surface and a snap-fit device connected to the connector housing, the snap-fit device including a U-shaped bending bar; and wherein the U-shaped bending bar includes a first limb and a second limb, the first limb secured to the outer support member with a first connecting end, the second limb having an unattached end and an orifice, the orifice positioned substantially at the unattached end for engaging with the mating snap-on surface of the mating connector when the electrical plug connector is inserted into the mating opening of the mating connector, and a support point member positioned approximately at a center portion of the second limb, and wherein the snap-fit device is pre-molded to the connector housing and is locked-in with the mating connector when the bending bar deflects and the support point member makes contact with the outer support member.

5. The electrical plug connector as recited in claim 4, wherein the snap-fit device is released from the mating connector when the bending bar rebounds and the support point member lifts away from the outer support member.

6. An electrical plug connector for electrically connecting and mechanically interlocking with a mating connector, the mating connector having a mating snap-on surface and a mating opening, the electrical plug connector comprising:

a connector housing having an outer support member; and a snap-on surface and a snap-fit device connected to the connector housing, the snap-fit device including a U-shaped bending bar, wherein the U-shaped bending bar includes a first limb and a second limb, the first limb secured to the outer support member with a first connecting end, the second limb having an unattached end and an orifice, the orifice positioned substantially at the unattached end for engaging with the mating snap-on surface of the mating connector when the electrical plug connector is inserted into the mating opening of the mating connector, and wherein the connector housing includes a circumferential flange, the outer support member positioned at a surface of the flange.

7. The electrical plug connector as recited in claim 6, wherein the first and second limbs are positioned substantially parallel to the plug connector.

8. The electrical plug connector as recited in claim 6, wherein the bending bar includes a base for joining the first and second limbs.

9. The electrical plug connector as recited in claim 6, further comprising a connecting member including a plurality of polarization ribs, the polarization ribs having a predetermined position for creating a polarization code.

10. The electrical plug connector as recited in claim 6, further comprising a connecting member including a tubular ring-shaped seal having an seal surface area, the ring-shaped seal including transverse ribs positioned on the seal surface area.

11. An electrical plug connector for connecting and interlocking with a mating connector, comprising:

a connector housing having an outer support member and a flange;

a connecting member having an opening for inserting into the mating connector; and a snap-fit device pre-molded with the flange of the connector housing, the snap-fit device including a U-shaped bending bar, the snap-fit device including a first limb and a second limb, the first limb having a first end for attaching the snap-fit device at or near the connector housing, the U-shaped bending bar having an engaging member for interlocking with a snap-on surface of the mating connector, the engaging member including an orifice.

12. The electrical plug connector as recited in claim 11, wherein the snap-fit device is molded with the connector housing.

13. The electrical plug connector as recited in claim 11, wherein the second limb of the bending bar includes a support point member for the bending bar.

14. The electrical plug connector as recited in claim 13, wherein the snap-fit device is locked-in with the mating connector when the bending bar deflects and the support point member makes contact with the outer support member; and the snap-fit device is released from the mating connector when the bending bar rebounds and the support point member lifts away from the outer support member.

15. The electrical plug connector as recited in claim 11, wherein the snap-fit device includes a grip strip for actuating the bending bar with a finger, the grip strip provided on an unattached end of the second limb.

16. The electrical plug connector as recited in claim 11, wherein the connector housing includes a flange for attaching the bending bar to the outer support member, the first and second limbs positioned substantially parallel to the plug connector.

17. The electrical plug connector as recited in claim 16, wherein the bending bar includes a base for joining the first and second limbs.

18. The electrical plug connector as recited in claim 11, wherein the connecting member includes a plurality of polarization ribs, the polarization ribs having a predetermined position for creating a polarization code.

19. The electrical plug connector as recited in claim 11, wherein the connecting member includes a tubular ring-shaped seal having a seal surface area, the ring-shaped seal includes transverse ribs positioned on the seal surface area.

* * * * *